US005890534A

United States Patent [19]

Burge et al.

[11] Patent Number: 5,890,534

[45] Date of Patent: Apr. 6, 1999

[54] VARIABLE INJECTOR

[75] Inventors: Philip Burge, The Hague, Netherlands; Peter Fontana, Houston, Tex.; Friedhelm Makohl, Hermmansburg, Germany

[73] Assignee: Baker Hughes Incorporated, Houston, Tex.

[21] Appl. No.: 937,717

[22] Filed: Sep. 25, 1997

Related U.S. Application Data

[63] Continuation of Ser. No. 825,000, Mar. 26, 1997, which is a continuation of Ser. No. 543,683, Oct. 16, 1995, abandoned, which is a continuation-in-part of Ser. No. 524,984, Sep. 8, 1995, abandoned, which is a continuation of Ser. No. 402,117, Mar. 10, 1995, abandoned.

[51] Int. Cl.[6] ..... E21B 19/22

[52] U.S. Cl. ..... 166/77.3

[58] Field of Search ..... 166/77.1, 77.2, 166/77.3, 384, 385

[56] References Cited

U.S. PATENT DOCUMENTS

| | | | |
|---|---|---|---|
| 1,656,215 | 1/1928 | McDonald . | |
| 1,886,209 | 11/1932 | Vest . | |
| 2,555,851 | 6/1951 | Hancock | 242/115 |
| 2,797,880 | 7/1957 | Miller | 242/110 |
| 2,960,311 | 11/1960 | Scott | 255/19 |
| 3,009,521 | 11/1961 | Failing | 175/127 |
| 3,313,346 | 4/1967 | Cross | 166/0.5 |
| 3,363,880 | 1/1968 | Blagg | 254/135 |
| 3,494,211 | 2/1970 | Reynard | 74/230.24 |
| 3,504,866 | 4/1970 | Palynchuk | 242/86.5 |
| 3,614,019 | 10/1971 | Slator | 242/157.1 |
| 3,841,407 | 10/1974 | Bozeman | 166/315 |
| 3,884,311 | 5/1975 | Eddy | 173/57 |
| 4,154,310 | 5/1979 | Konstantinovsky | 175/40 |
| 4,463,814 | 8/1984 | Horstmeyer et al. | 175/45 |
| 4,515,220 | 5/1985 | Sizer et al. | 166/384 |
| 4,585,061 | 4/1986 | Lyons | 166/77 |
| 4,655,291 | 4/1987 | Cox | 166/385 |
| 4,899,823 | 2/1990 | Cobb | 166/351 |
| 5,002,130 | 3/1991 | Laky | 166/351 |
| 5,094,340 | 3/1992 | Avakov | 198/626.1 |
| 5,133,405 | 7/1992 | Elliston | 166/77.3 |
| 5,188,174 | 2/1993 | Anderson, Jr. et al. | 166/77.3 |
| 5,215,151 | 6/1993 | Smith et al. | 175/45 |
| 5,244,046 | 9/1993 | Council et al. | 166/380 |
| 5,287,921 | 2/1994 | Blount et al. | 166/117.6 |
| 5,294,956 | 3/1994 | Mueller et al. | 175/67 |
| 5,309,990 | 5/1994 | Lance | 166/77.3 |
| 5,311,952 | 5/1994 | Eddison et al. | 175/61 |
| 5,339,913 | 8/1994 | Rives | 175/73 |
| 5,370,180 | 12/1994 | Barbee | 166/178 |
| 5,553,668 | 9/1996 | Council et al. | 166/77.3 |

FOREIGN PATENT DOCUMENTS

| | | |
|---|---|---|
| 2 055 781 | 4/1971 | France . |
| 955 193 | 4/1964 | United Kingdom . |
| 996 063 | 6/1965 | United Kingdom . |
| 2 183 600 | 6/1987 | United Kingdom . |
| 2 238 294 | 5/1991 | United Kingdom . |
| WO 92/18741 | 10/1992 | WIPO . |

OTHER PUBLICATIONS

Burge, Phil; *Modular Rig System—Advances in CTD/SHD Rigs;* 10 pages; Oct. 17, 1995; Second European Coiled Tubing Roundtable.

Koen, A.D.; *Use of Coiled Tubing Fans Out Among Well Sites of the World;* pp. 18–22; Oct. 3, 1994; Oil & Gas Journal.

Sas–Jaworsky, Alexander; *Coiled Tubing—Operations and Services;* pp. 41–47; Nov. 1991; World Oil, vol. 212, No. 11.

*Shell Pressing Coiled Tubing Programs in California;* pp. 31–32; Jun. 27, 1994; Oil & Gas Journal.

*Primary Examiner*—William Neuder

*Attorney, Agent, or Firm*—J. Albert Riddle; Gregory E. Upchurch

[57] ABSTRACT

Apparatus for handling pipe, coiled tubing, casing, and conventional tubing in well drilling and servicing operations.

16 Claims, 5 Drawing Sheets

VARIABLE INJECTOR

CROSS REFERENCE TO RELATED APPLICATIONS

This is a continuation patent application of co-pending U.S. patent application Ser. No. 08/825,000 filed on Mar. 26, 1997, and entitled "Coiled Tubing Apparatus", which was a continuation of U.S. patent application Ser. No. 08/543,683, filed on Oct. 16, 19995, and entitled "Coiled Tubing Apparatus", now abandoned, which was a continuation-in-part of U.S. patent application Ser. No. 08/524,984, filed on Sep. 8, 1995, and entitled "Modular Rig Design", now abandoned, which was a continuation of U.S. patent application Ser. No. 08/402,117, filed on Mar. 10, 1995, and entitled "Modular Rig Design", now abandoned.

FEDERALLY SPONSORED RESEARCH OR DEVELOPMENT

Not Applicable

BACKGROUND OF THE INVENTION

This invention relates to the use and handling of pipe and tubing in various well operations. More specifically, the invention relates to the use of pipe and tubing and the like being handled with tubing injectors in drilling and well servicing operations.

Jointed pipe or tubing are typically run into wells during well drilling or servicing operations using either a drilling rig or a workover rig. Such rigs can be expensive and time consuming to use. To help minimize some problems in the time and expense of using jointed piped or tubing in well drilling and well servicing operations coiled tubing has been used in its place on a selective basis. Typically, coiled tubing has been used in well servicing operations where time and convenience are important considerations.

In such coiled tubing use, the coiled tubing used has been of the small diameter type where the nominal bore of the coiled tubing is approximately one-inch. The use of such small diameter tubing has occurred in well servicing operations in an effort to provide the maximum amount of tubing mounted on reels that are easily transported over the road on conventionally licensed vehicles to and from well sites. Also, the small diameter coiled tubing may be conveniently transported in reel form installed on skid units to remote locations and offshore. However, such small diameter coiled tubing limits the flow of fluids therethrough, the amount of compression force that can be transmitted through the string of coiled tubing in the well, the amount of tension force that can be transmitted through the string of coiled tubing in the well, the amount of torque that may be applied to the coiled tubing during use in a well, the types of tools that may be used on coiled tubing in a well, the weight of tools that may be used on the string of coiled tubing in the well at any depth, and the length of coiled tubing that may be used in any well.

With the advent of using coiled tubing in a wider variety of well servicing operations and well drilling operations it is desirable and necessary to use larger diameter coiled tubing than in the past, such as three and one-half inches external diameter or greater as may be available from time to time. However, the use of such larger diameter coiled tubing creates a series of problems when coiled tubing handling apparatus designed for handling the small diameter coiled tubing exists is used.

Conventional coiled tubing handling equipment for handling small diameter coiled tubing typically comprises, in simplest form, a reel of coiled tubing mounted on a platform, such as a vehicle, an injector including an integrally attached gooseneck to run the coiled tubing into and from the well, a lifting device to support the injector when running the coiled tubing into and from the well, a power pack to provide power to the reel, to reel the tubing in the well, lifting device to support the injector, the injector to run the coiled tubing into and from the well, and surface equipment to seal around the coiled tubing as it is run into and from the well, such as strippers and/or blow-out preventors.

The vehicle is typically a trailer, pulled by a tractor, upon which the coiled tubing and accessories are mounted to be transported to a well site. Alternatively, a skid unit may be used in place of a vehicle trailer. A hydraulically powered reel is used to run the string of coiled tubing into and from the well. The reel may be of various sizes depending upon the size of the coiled tubing to be reeled thereupon, the length of coiled tubing to be reeled, the size limits of the vehicle for over the road transport, the weight limits for vehicular transport over the road, etc. The lifting device used to support the coiled tubing is typically a hydraulically powered boom or crane which is located at the rear of the trailer so that it may be located adjacent the well and its surface equipment for supporting the injector and gooseneck thereover during coiled tubing operations. The injector having an integrally attached gooseneck is hydraulically powered comprising drive chains having fixed geometry tubing grippers located thereon mounted on beams to run the coiled tubing into and from the well. The integrally mounted gooseneck on the injector typically comprises a curved member, forming a small radius bend having an approximately ninety degree (90°) arc, or less, for directing the coiled tubing between the drive chains of the injector after the tubing has been received, generally horizontally or at a slight angle, from the reel. The gooseneck further includes a plurality of pairs of roller assemblies for the coiled tubing rest upon while being directed by the gooseneck into the injector. The power pack comprises one or more engines driving one or more hydraulic pumps to power the reel, boom or crane, injector, and any surface equipment desired. The power pack may also be used to provide power to any other hydraulic accessory desired.

Since the gooseneck is permanently attached to the injector, the injector must be suspended from the hydraulic boom over the surface equipment of the well at the well site requiring the assembly and disassembly of equipment to be run into the well to occur after the coiled tubing has been run through the gooseneck and the injector. This creates a difficult and sometimes hazardous working environment at the well site in a confined area surrounded by well service equipment.

In some instances, if in addition to coiled tubing, it is required to use jointed pipe, casing, or tubing to be included in the work string used in the well, it will be necessary to use a jack-up frame and power tongs in addition to the normal completion equipment used in coiled tubing operations. In such instances, the injector having an integrally mounted gooseneck thereon will be mounted above the work deck of the jack-up frame for the coiled tubing use. This necessitates the removal of the injector and gooseneck during any operations not utilizing the running of the coiled tubing into and from the well as the jointed pipe, casing or tubing cannot be run through the injector as the grippers of the injector are designed to handle solely coiled tubing of a predetermined external diameter which cannot be varied without changing the grippers on the drive chains of the injector.

In order to improve the efficiency of all types of well drilling and servicing operations it is desirable to use and run pipe, coiled tubing, casing and tubing into and from a well using the same equipment. To do so an injector must be used along with associated equipment that is capable of handling drill pipe of various diameters, coiled tubing of various diameters, well casing of various diameters and tubing of various diameters. Additionally, the equipment used to handle such pipe, coiled tubing, casing, and tubing must occupy the smallest possible space at the well site and be easily transported thereto and therefrom. On-land, offshore, and remote well sites must be considered when using such equipment.

In using coiled tubing it is also desirable to minimize the amount of bending and permanent deformation of the tubing during its use to help prevent fatigue failure of the tubing. When large diameter coiled tubing is used with equipment which is designed to handle smaller diameter coiled tubing, such use may only cause greater bending and permanent deformation of the tubing and its subsequent early fatigue failure because the large diameter tubing is being reeled, supported, and run into a well under the same conditions as smaller diameter coiled tubing which normally utilizes equipment employing smaller reel diameters, smaller radius of bending and support, etc.

It is known to use a mechanism to raise and lower pipe while providing a means for rotating the pipe. Such a device is shown in U.S. Pat. No. 3,191,450.

It is also known to use an injector for injecting coupled pipe into a well using a pair of endless chains to hold the pipe therebetween during running operations. Such an injector is described in U.S. Pat. No. 3,285,485. However, the high loads of squeezing of the pipe between the pair of endless chains tends to deform the pipe couplings making it difficult to disassemble the pipe and reuse it.

It is further well known to use an injector to run coiled tubing to support the tubing without the use of a derrick. Such an injector is shown in U.S. Pat. No. 3,331,346.

It is known to use an apparatus similar to a coiled tubing injector to run sucker rods into and from a well. Such an apparatus is shown in U.S. Pat. No. 3,559,905.

It is also known to use an apparatus to make up a pipe string continuously as it is being run into and from a well. Such an apparatus is shown in U.S. Pat. No. 3,677,345.

It is further known to use gripper pads on drive chains in a sucker rod injector apparatus. Such an apparatus is shown in U.S. Pat. No. 3,754,474.

It is further known to use injectors having movable rails and endless chain drives to allow the use of coiled tubing or jointed pipe to be run through the injectors without the use of a derrick at the well site. Such an apparatus is shown in U.S. Pat. No. 4,655,291, which shows an injector with a pair of chains, each of which is mounted on a rail or pressure beam which is transversely movable with respect to the injector housing.

BRIEF SUMMARY OF THE INVENTION

The present invention is directed to an apparatus for use in running drill pipe, coiled tubing, casing, and tubing into and from a well without the need of a drilling rig or workover rig on the well site. The present invention is further directed to an apparatus for running coiled tubing into a well to minimize the damage to the tubing from bending or deformation during the reeling of the tubing, the use of the gooseneck, or use of the injector.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
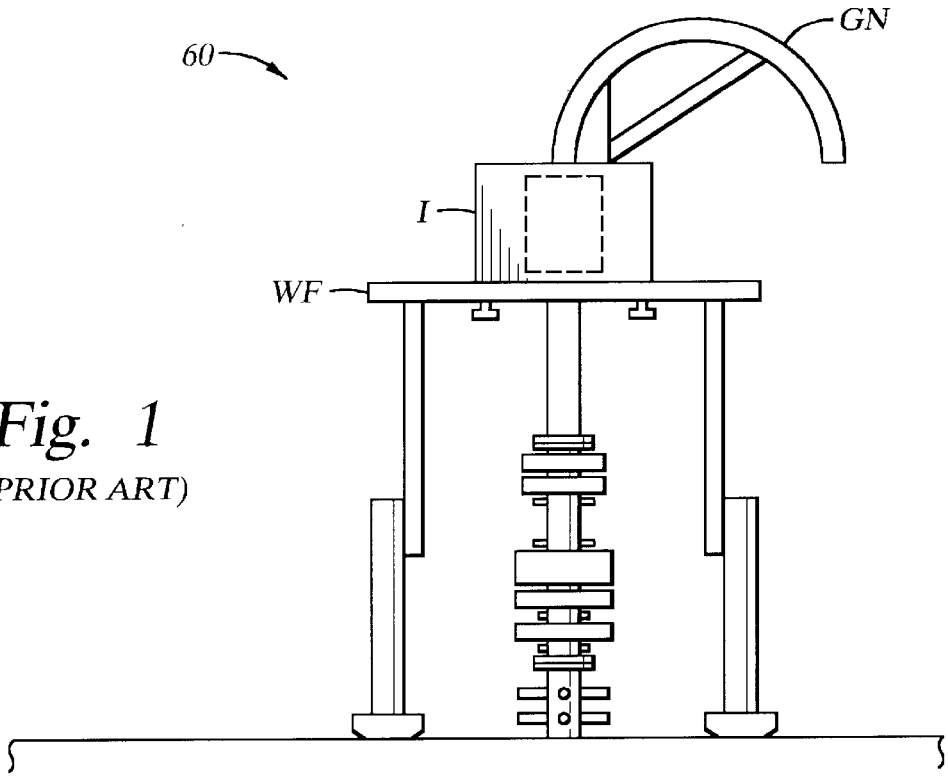
Fig. 1 (PRIOR ART)
FIG. 1A is a conventional prior art injector and gooseneck handling system.
FIG. 1B is a detail drawing of a prior art injector, showing a pair of chains mounted on a pair of transversely movable pressure beams.

Referring to drawing FIG. 1A, a conventional guidance system GS is shown. A conventional injector I is mounted on work floor WF having arcuate gooseneck GN connected thereto in a fixed relationship. To remove the bottom hole assembly the injector I and gooseneck GN must be removed from work floor WF above the wellhead while the coiled tubing is supported by the grappling connection (not shown) by a suitable crane or boom (not shown).

Figure 1B:
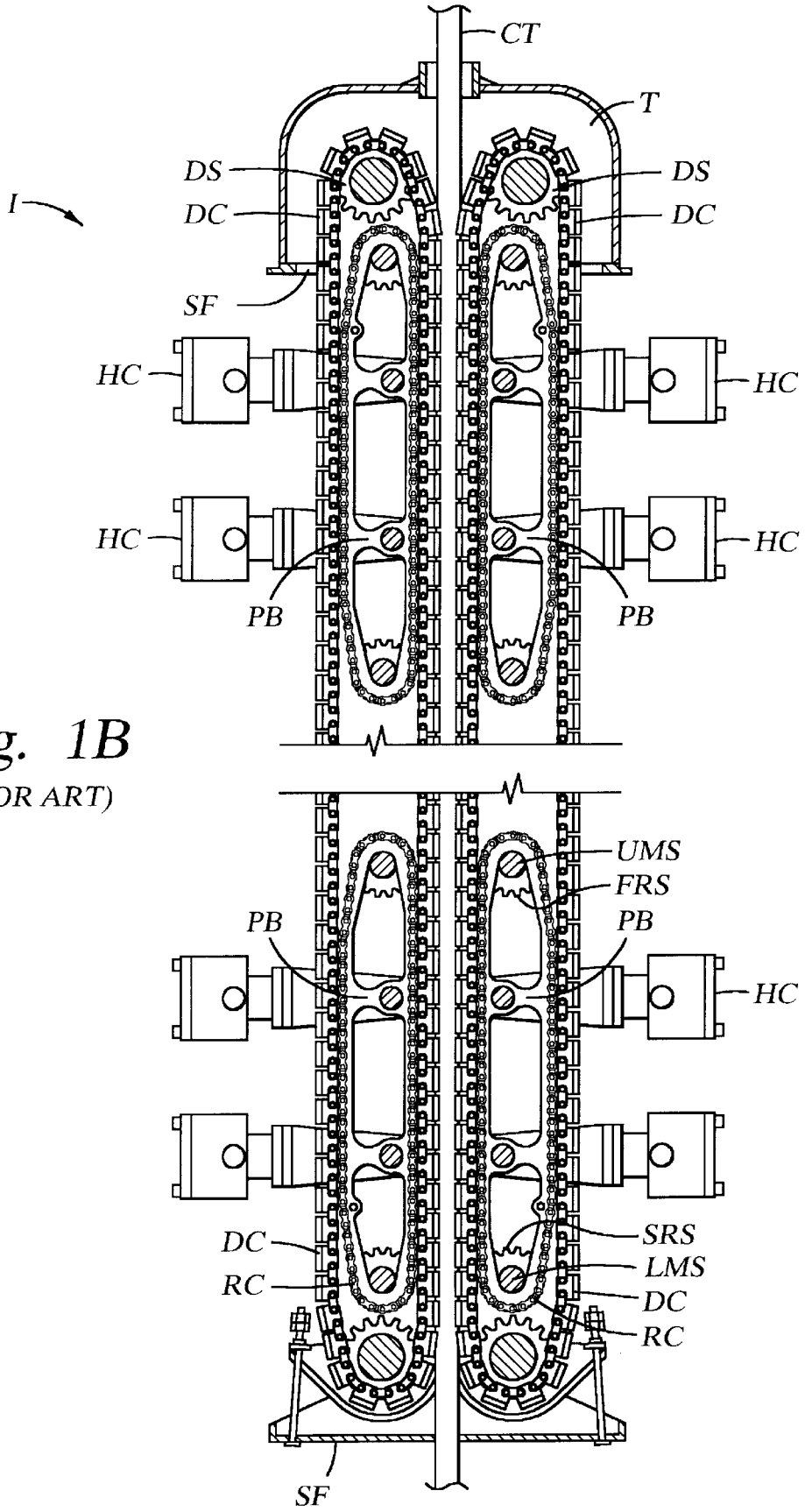
Fig. 1B (PRIOR ART)

Referring to drawing FIG. 1B, a prior art injector I is shown, being identical to the injector disclosed in U.S. Pat. No. 4,655,291. A transmission T is mounted to a support frame SF superstructure, and a pair of drive sprockets DS are driven by the transmission T. The drive sprockets DS drive a pair of drive chains DC, which in turn drive the coiled tubing CT. Two upper substructures, pressure beams PB, and two lower substructures, pressure beams PB, are used to move the drive chains DC into contact with the coiled tubing CT. The two upper pressure beam PB substructures are vertically spaced apart from the two lower pressure beam PB substructures, to allow the passage of tubing joints or other components, by gripping the coiled tubing CT with the upper substructures while the lower substructures are transversely spread apart, and vice versa. The two upper pressure beam substructures are horizontally spaced apart from each other, and capable of transverse movement toward and away from each other. A roller chain RC is mounted on each pressure beam PB substructure, and each substructure is transversely movable relative to the superstructure, or support frame SF, by a pair of hydraulic cylinders HC. Each roller chain is engaged with first and second roller sprockets FRS and SRS, the sprockets being mounted on upper mounting shafts UMS and lower mounting shafts LSM as shown. The drive chains DC are fixedly mounted relative to the support frame SF, rather than being transversely movable with the pressure beam PB substructures.

Figure 2:
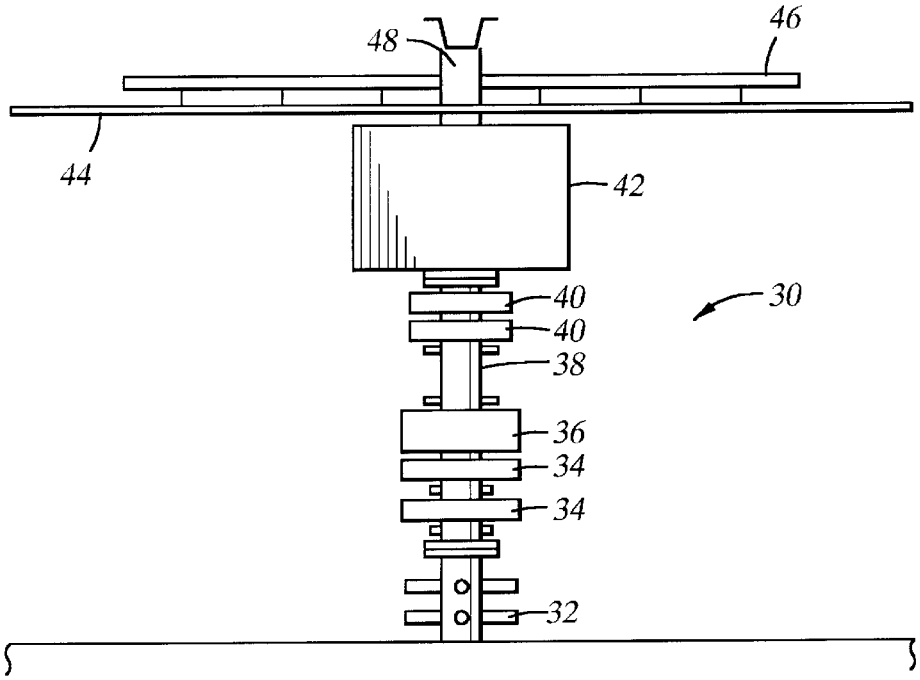
FIG. 2 is a schematic diagram of the deployment system of the present invention.

Referring to drawing FIG. 2, the coiled tubing deployment and blow-out preventer system 30 of the present invention is shown. The system 30 comprises a wellhead master valve or safety valve 32, tubing cutting or shear rams 34, annular blow-out preventer 36, riser pipe 38 of any desired length, a dual pipe or tubing stripper 40, injector head 42 of suitable design, injector head and blow-out preventer crane 44, working platform 46, and suitable pipe handling slips and centralizer assembly 48.

As noted, the injector head 42 is positioned above the riser 38 which is connected to the blow-out preventer 36. The injector head 42 is not removed from the wellhead position for any operation. The injector head 42 comprises a variable width drive mechanism having variable size grippers therein to accommodate a range of varying diameters of jointed pipe, coiled tubing, casing, tubing and bottom hole assembly components to be passed therethrough. The injector head drive mechanism is capable of expanding or adjusting to varying sizes, as will be explained below, to allow bottom hole assembly components including drilling motors, accessories and drill bits to pass therethrough. The injector head is further capable of running and pulling either jointed pipe, coiled tubing, casing or conventional tubing and utilizes variable grippers on the drive chains to accommodate the same.

With the injector head 42 permanently mounted on the wellhead having the ability to allow bottom hole assembly components to pass therethrough, as well as the capability of running and pulling either jointed pipe, coiled tubing, casing, conventional tubing component handling is easily performed on the work platform 46 above the injector head 42 without interference. Tubing handling slips 48 including a rotary table, if desired, are located above the injector head 42. In this manner, either the jointed pipe, casing or tubing or the bottom hole assembly components may be pulled through the injector head 42, held in slips 48 and disassembled or made-up as required. This allows also for disassembly from the bit up of the bottom hole assembly when it is held in the guidance system discussed hereinafter.

Furthermore, when the bottom hole assembly is deployed or being made-up, the master valve 32 is closed, as well as the rams 34. The upper portion of the bottom hole assembly is made-up in the slips 48 and connected to the coiled tubing via the tubing grapple connector (not shown). When the assembly is finished, the strippers 40 are closed and the master valve 32 or blind rams 34 are opened. At this point the bottom hole assembly can be run into or from the well.

For recovery of the bottom hole assembly, it is pulled into the wellhead above the master valve 32 and rams 34 which are then closed and the fluid pressure bled off The strippers 40 are opened and the bottom hole assembly disassembled.

Figure 3:
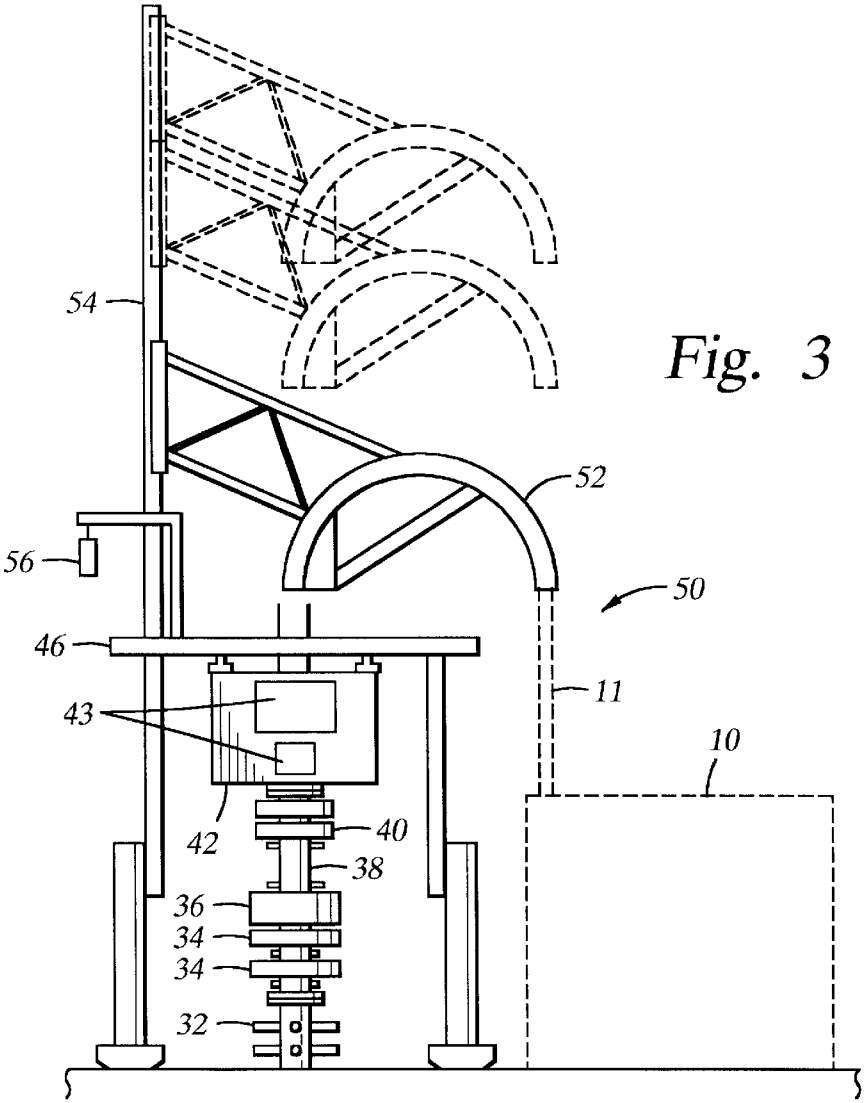
FIG. 3 is a drawing of the injector and gooseneck handling system of the present invention.

Referring to drawing FIG. 3, one arrangement of the injector and gooseneck handling or guidance system 50 is shown. The variable injector head 42 is mounted below the work platform 46. The variable injector head 42 contains one or more pairs of vertically spaced apart variable or adjustable tubing drive chain assemblies 43. The variable injector head 42 is therefore capable of pulling either jointed pipe, coiled tubing, casing, conventional tubing or bottom hole assemblies therethrough. A suitable control system is provided to operate the injector 42 to allow the joints on the jointed pipe, casing or jointed tubing to pass through the injector without permanent deformation.

The gooseneck 52 is independently mounted with respect to the injector 42 on a movable vertical hoist 54, such as a mast including a hydraulic cylinder which may have an integral shock absorber therein. The gooseneck 52 and the vertically spaced apart drive chain assemblies 43 pull the bottom hole assembly components free of strippers 40 so that disassembly thereof can be performed via remotely controlled power tong 56.

An important feature of the gooseneck 52 of the present invention is that it receives the coiled tubing from a coiled tubing module 10 as the coiled tubing is being reeled therefrom substantially vertically; i.e., a substantially vertical tangent line of the reel, and that it directs the coiled tubing into the injector 42 substantially vertically concentric with the vertical axis of the well and the surface equipment installed thereon. In this manner, the deformation of the coiled tubing is minimized during handling operations. It is preferred that the diameter of the gooseneck 52 of the present invention be at least as large as the smallest diameter of the tubing reel upon which the largest diameter coiled tubing is reeled to thereby minimize deformation of the coiled tubing by the gooseneck 52. More preferably, the diameter of the gooseneck 52 of the present invention be equal to the largest diameter of the tubing reel upon which the coiled tubing is reeled. Further, the gooseneck preferably comprises substantially a semi-circle, a 180 degree arc, to insure support of the coiled tubing throughout handling operations.

For handling of coiled tubing having an external diameter of approximately three and one-half inches (3½") the gooseneck preferably has a diameter of at least three meters and, preferably four meters or greater.

Alternately, if desired, the gooseneck 52 may be mounted directly on the coiled tubing reel (not shown) of the coiled tubing module to provide initial support and any desired straightening of the coiled tubing 11 as it is unreeled. The gooseneck 52 may include a suitable limited drive assembly (not shown) to push the coiled tubing through the guidance system at insertion and removal of the tubing from the wellhead. The gooseneck 52 remains substantially stationary with respect to the wellhead components during coiled tubing reeling operations with the reel (not shown) reciprocating and translating as the coiled tubing is reeled into and from the well.

The gooseneck 52 is supported by a vertical mast 54, with the gooseneck 52 being movable about and above the injector 42 to allow bottom hole assembly components and jointed pipe, casing and tubing to be handled above the wellhead and injector 42 for assembly and disassembly thereof.

Figure 4:
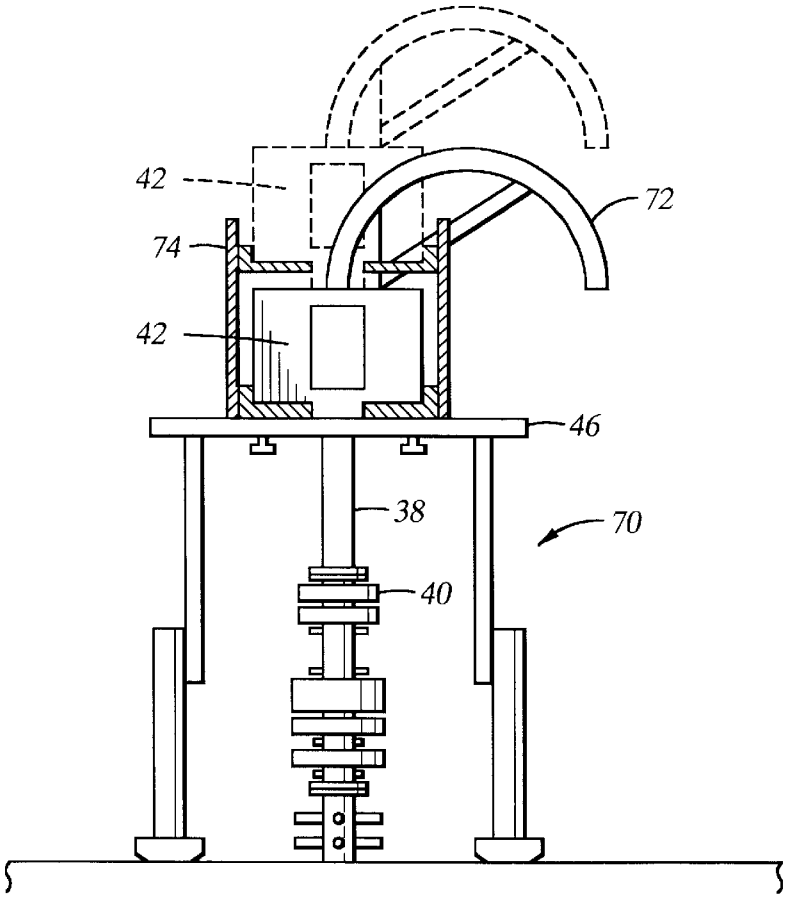
FIG. 4 is a drawing of an alternative embodiment of the injector and gooseneck handling system of the present invention.

Referring to drawing FIG. 4, an alternative guidance system 70 of the present invention is shown. A conventional or variable injector 42 has mounted thereon a large diameter gooseneck 72 as described hereinbefore to support the coiled tubing substantially throughout a 180° arc during operations. A riser 38 is located above a stripper 40, both being mounted below injector head 42. The conventional or variable head injector 42 is mounted via suitable hydraulic platform 74 on work platform 46.

To remove the bottom hole assembly from the wellhead the injector head 42 is moved upwardly by hydraulic platform 74 to pull the bottom hole assembly through stripper 40. Then, the bottom hole assembly is disassembled from the bit up from work platform 46.

Figure 5:
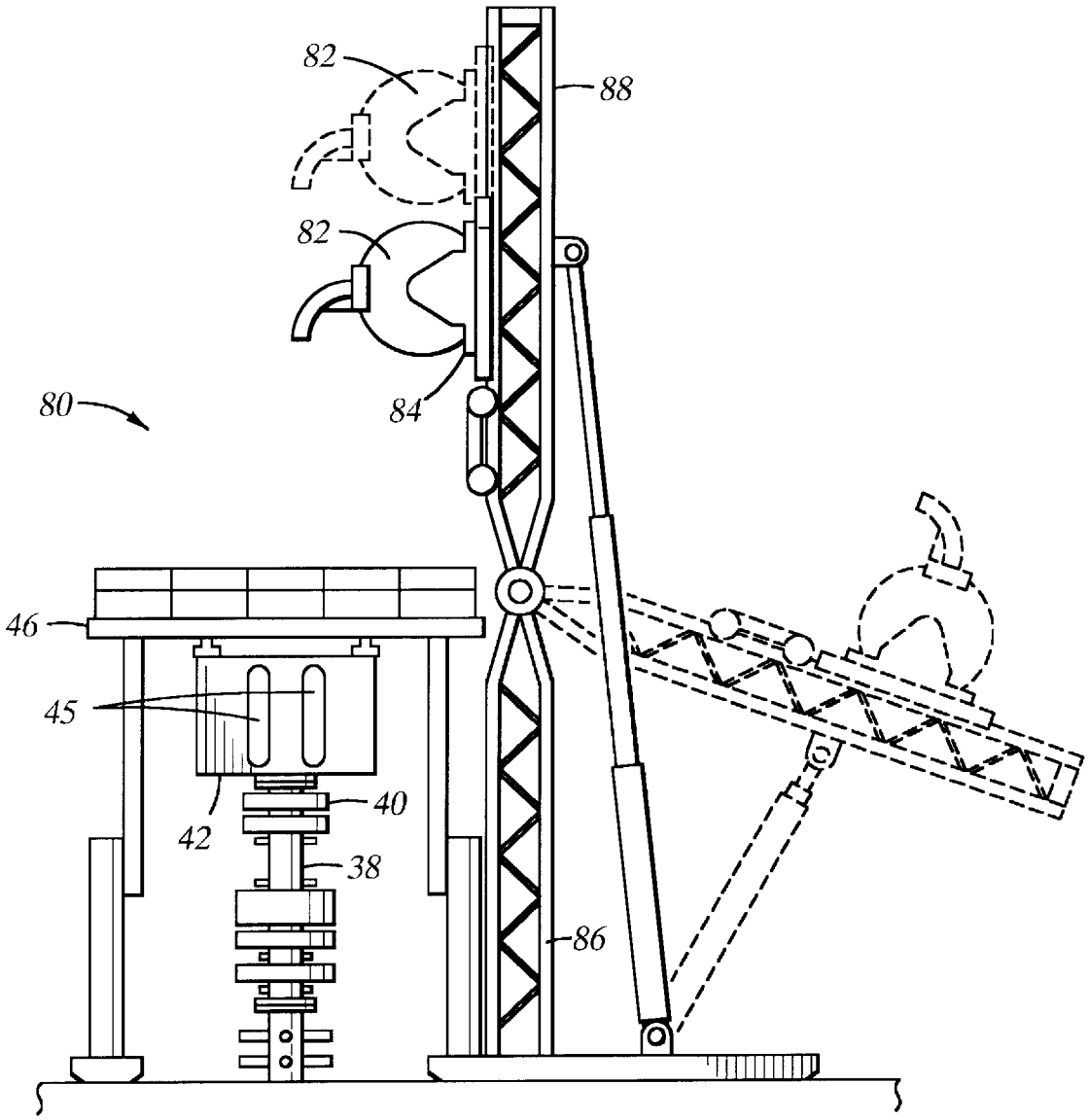
FIG. 5 is a second alternative embodiment of the injector and gooseneck handling system of the present invention.

Referring to drawing FIG. 5, a second alternative guidance system 80 of the present invention is shown. The variable injector head 42 is mounted below the work platform 46. The variable injector head 42 comprises horizontally spaced apart adjustable chain drive assemblies 41, to allow varying sizes of coiled tubing, pipe, casing, and tubing to be used therewith as well as a bottom hole assembly to pass therethrough.

The coiled tubing is mounted on a reel 82 mounted on movable trolley 84 on mast 86. To remove the bottom hole assembly from the wellhead the variable injector head 42 pulls the coiled tubing from the well until the bottom hole assembly reaches the bottom of the injector head 42. The chain drive assemblies 41 are disengaged from the coiled tubing and the chain drive assemblies 41 are spread apart to allow the coiled tubing having bottom hole assembly connected thereto to be pulled through the variable injector head 42 by the reel 82 of coiled tubing being moved up the mast 86 by trolley 84 located thereon. In this manner, the bottom hole assembly is pulled up to the work platform 46 where it may be disassembled from the bit up.

When disassembly is completed of the bottom hole assembly, the upper portion 88 of the mast 86 may be laid down to the position shown in broken lines in drawing FIG. 5.

The variable injector heads 42 of each embodiment of the present invention may use multiple pairs of drive chains, variable width chain drive assemblies and variable inserts or grippers (such as those shown in FIG. 1B) thereon to allow varying sizes of either jointed pipe, coiled tubing, casing, or tubing to be used therewith. Either multiple injector heads having variable width chain drive assemblies and/or modified multiple pairs of drive chains having variable chain inserts or grippers thereon may be run in series and controlled to alternately grip and release either the casing, jointed pipe, jointed tubing or coiled tubing to allow the joints to pass through the injector heads without interference.

To reduce the load on the injector head while running well casing or well casing liners, the casing can be floated into the well by using a float shoe or collar located thereon with the casing being selectively filled with fluid to maintain neutral or negative buoyancy.

Also, the slips 48 shown in drawing FIG. 2 may be used to support casing during wellcementing operations, if desired, thereby lowering the stress on the injector head 42.

Additionally, since the injector heads 42 may use multiple pairs of drive chains, or variable widths and include modified or variable inserts or grippers, composite strings of either drill pipe and casing or drill pipe and coiled tubing or jointed pipe and tubing, or jointed tubing and coiled tubing may be run to reduce the loads on the injector heads 42.

Figure 6:
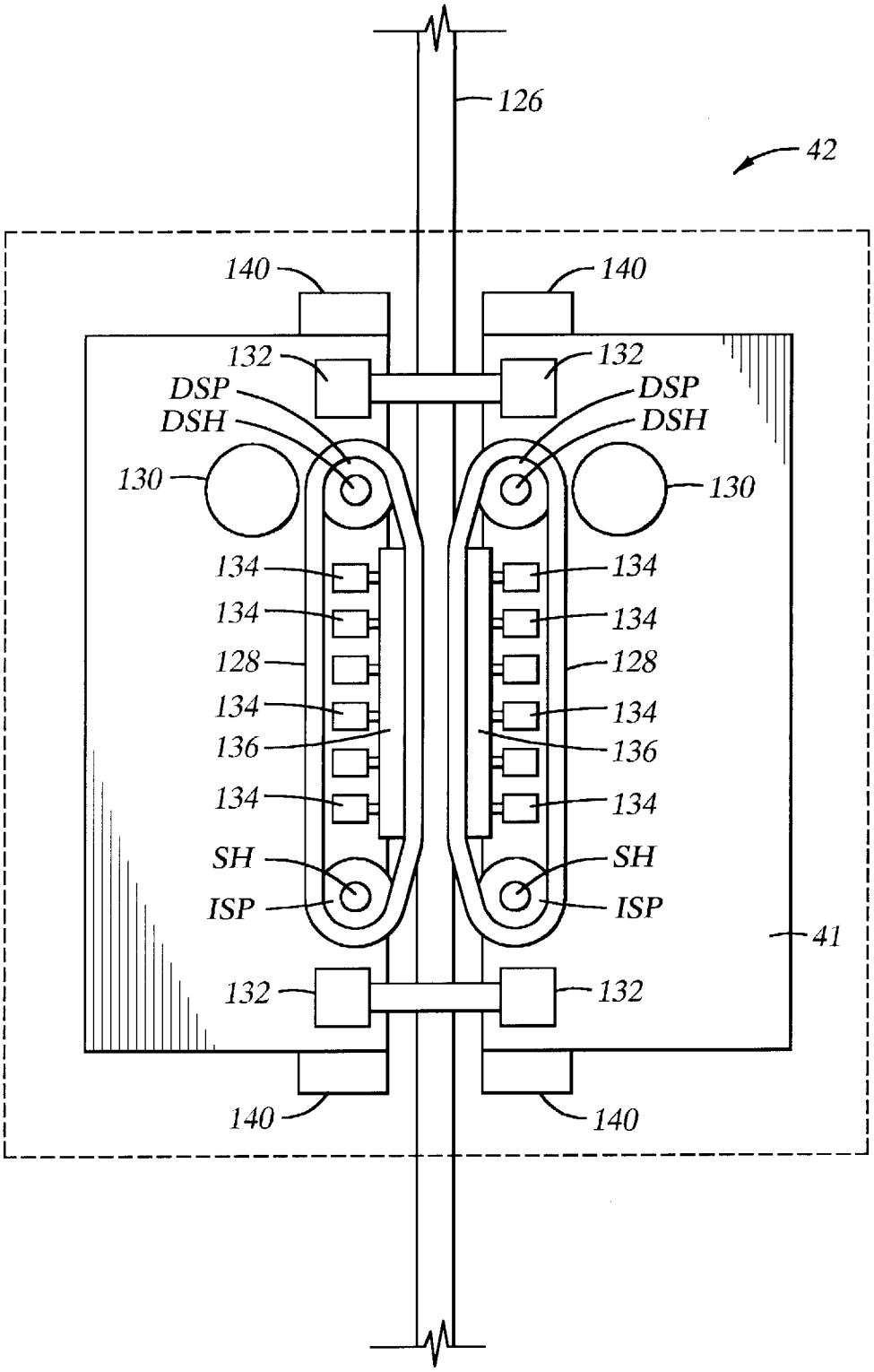
FIG. 6 is a view of a pipe injecting apparatus of the present invention.

Referring now to FIG. 6, a type of the pipe injection apparatus contemplated by this invention that is shown schematically and indicated generally by the reference numeral 42.

The apparatus 42 may be supported upon a plurality of legs (not shown) which are in turn supported upon a platform or plate (not shown) mounted together with a stripper head (not shown) and stationary slips (not shown) upon a conventional Christmas tree (not shown).

The apparatus 42 may be stabilized in a vertical position by a suitable number of guy lines or supports.

A work platform (not shown) is normally mounted atop the apparatus to support workers and ancillary equipment such as a control console, and the like. Further, a gin pole and hoist (not shown) are normally provided to handle pipe and other objects. The work platform and the gin pole and hoist have been omitted from the drawing.

Apparatus 42 is useful in running pipe or tubing 126 into or out of a well. The tubing may be coiled tubing, or it may be jointed tubing or pipe such as pipe sections connected together with collars or couplings or other type having enlarged sections at the threaded connections as well as casing.

The pipe string 126 passes through the apparatus 42 and is held in the grip of a pair of horizontally spaced apart chain drive substructure assemblies 41 as described above, including opposed drive chains 128 which have variable diameter tubing engaging blocks or gripping inserts thereon disposed in a common plane and which have portions thereof which are forced against the pipe for friction gripping engagement therewith. The drive chains 128 are driven by hydraulic motors 130 having sprockets over which the chains travel. The sprockets (labeled DSP) are mounted on rotatable drive shafts DSH in the conventional manner like that shown in FIG. 1B. The lower reach of each chain assembly is engaged by idler sprockets ISP mounted on rotatable idler shafts SH, also in the conventional manner like that shown in FIG. 1B. The chains are drivable in a direction to move the pipe 126 into the well, or to move the pipe out of the well, as desired. Pressurized hydraulic fluid also is used to power the mechanism for gripping or releasing the pipe and to power other equipment such as slips and the like.

The gripping mechanism includes at least one set of hydraulic actuator tensioning cylinders 132 to transversely move chain drive substructure assemblies 41 toward or away from each other, to thereby selectively maintain gripping resistance on the drive chains 128. The apparatus 42 further includes a plurality of independently actuated hydraulic cylinders 134 to further adjust the width or space between chains 128 to handle varying sizes of casing, drill pipe, coiled tubing or conventional tubing. Each hydraulic cylinder 134 adjusts a portion of the beams or rails 136 upon which the chains 128 ride. The beams or rails 136 may include friction reducing members thereon, such as wear pads or rollers. This assembly offers an improvement over the injector disclosed in U.S. Pat. No. 4,655,291 in that each entire chain drive substructure assembly 41 in the present invention is independently movable transversely relative to the injector 42 superstructure, rather than merely having pressure beam adjustments for a portion of the length of each drive chain.

The pipe string 126 may be assembled as it is run into the well, or it can be fed from a reel or basket via suitable guide means to the apparatus.

The apparatus 42 may include multiple pairs of vertically spaced apart drive chains 128 in drive chain assemblies 43 as shown in FIG. 3, to allow jointed pipe casing or tubing to pass therethrough without damage to the connections thereon. One pair of drive chains 128 being interlocked by control means on the jointed pipe, casing or tubing while the other pair of drive chains is released so that the joint may pass through. A suitable control means is used for the purpose of controlling such apparatus 42 including appropriate sensing means 140.

Based upon the foregoing, it can be easily seen that the apparatus of the present invention is capable of running either jointed pipe, casing or tubing in addition to various sizes of coiled tubing used in wells. The apparatus also minimizes damage to the coiled tubing from inadequate support and small bending radius goosenecks. The apparatus further provides an independently mounted gooseneck which is movable and readily positioned with respect to the injector. Additionally, the injector is mounted below the work surface, being secured to the surface equipment at the well site, having readily variable width drive chains and chain beams to allow the passage of jointed pipe, casing, jointed tubing and bottom hole components therethrough. Also, the bottom hole components may be assembled, disassembled, and attached to the coiled tubing string on the work platform for use in the well without interference from the injector.

Having thus described my invention, those of ordinary skill in the art will recognize that various changes, additions, deletions and modifications may be made that are within the scope of the invention.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A tubing injection apparatus, comprising:

a housing; and at least one chain drive assembly mounted within said injector, said entire chain drive assembly being transversely movable within said housing between a first position for engaging tubing extending through said housing and a second position not engaging the tubing.

2. A tubing injection apparatus as recited in claim 1, further comprising a pair of opposed said chain drive assemblies positioned relative to each other to engage and disengage tubing disposed therebetween.

3. A tubing injection apparatus as recited in claim 1, wherein said chain drive assembly comprises:

a rotatably mounted drive shaft;

a drive sprocket mounted on said drive shaft;

a rotatably mounted idler shaft;

an idler sprocket mounted on said idler shaft; and a drive chain engaged with said drive and idler sprockets whereby, as said drive sprocket is rotated, said drive chain is moved, thereby moving the tubing through said injector.

4. A tubing injection apparatus as recited in claim 3, further comprising a roller chain system adapted for engagement with said drive chain for supporting said drive chain when said drive chain is engaged with the tubing.

5. A tubing injection apparatus as recited in claim 4, wherein said roller chain system is mounted on said chain drive assembly.

6. A tubing injection apparatus as recited in claim 4, wherein said roller chain system is mounted on a pressure beam rigidly positioned in said chain drive assembly.

7. A tubing injection apparatus as recited in claim 6, wherein said roller chain system comprises:

an upper mounting shaft mounted on said linear beam;

a first roller sprocket mounted on said upper mounting shaft;

a lower mounting shaft mounted on said linear beam;

a second roller sprocket mounted on said lower mounting shaft; and a roller chain engaged with said roller sprockets.

8. A tubing injection apparatus as recited in claim 3, wherein said chain drive assembly is one of a pair.

9. A coiled tubing injection apparatus, comprising:

an injector head including a frame constituting a superstructure;

at least one chain drive assembly constituting a substructure mounted to said superstructure, said chain drive substructure being transversely movable with respect to said superstructure; and a chain drive assembly mounted on each substructure and movable therewith, said chain drive assembly being adapted for engaging coiled tubing extending through said superstructure when said chain drive substructure is moved toward the tubing.

10. A coiled tubing injection apparatus as recited in claim 9, further comprising a pair of opposed said chain drive substructures positioned relative to each other to engage and disengage tubing disposed therebetween.

11. A coiled tubing injection apparatus as recited in claim 9, wherein said chain drive assembly comprises:

a drive shaft rotatably mounted on said chain drive substructure;

a drive sprocket mounted on said drive shaft;

an idler shaft rotatably mounted on said chain drive substructure;

an idler sprocket mounted on said idler shaft; and a drive chain having tubing engaging blocks attached thereto and engaged with said drive and idler sprockets whereby, as said drive sprocket is rotated, said drive chain is moved, thereby moving the tubing through said superstructure.

12. A coiled tubing injection apparatus as recited in claim 11, further comprising a roller chain system adapted for engagement with said drive chain for supporting said drive chain when said drive chain is engaged with the tubing.

13. A coiled tubing injection apparatus as recited in claim 12, wherein said roller chain system is mounted on said drive chain substructure.

14. A coiled tubing injection apparatus as recited in claim 12, wherein said roller chain system is mounted on a pressure beam rigidly positioned in said drive chain substructure.

15. A coiled tubing injection apparatus as recited in claim 14, wherein said roller chain system comprises:

an upper mounting shaft mounted on said beam;

a first roller sprocket mounted on said upper mounting shaft;

a lower mounting shaft mounted on said beam;

a second roller sprocket mounted on said lower mounting shaft; and a roller chain engaged with said roller sprockets.

16. A coiled tubing injection apparatus as recited in claim 11, wherein said drive chain substructure is one of a pair.

* * * * *